United States Patent [19]

Kinoshita

[11] Patent Number: 4,963,453

[45] Date of Patent: Oct. 16, 1990

[54] PHOTOSENSITIVE MEMBERS FOR USE IN ELECTROPHOTOGRAPHY

[75] Inventor: Koichi Kinoshita, 34–13, Nishi-Kusabuka-Cho, Shizuoka-Shi, Shizuoka-Ken, Japan

[73] Assignee: Koichi Kinoshita, Shizuoka, Japan

[21] Appl. No.: 308,996

[22] Filed: Feb. 8, 1989

Related U.S. Application Data

[63] Continuation of Ser. No. 81,999, Aug. 5, 1987, abandoned.

[30] Foreign Application Priority Data

Apr. 21, 1987 [JP] Japan ..... 62-97971

[51] Int. Cl.[5] ..... G03G 5/05

[52] U.S. Cl. ..... 430/96; 430/127

[58] Field of Search ..... 430/59, 96, 127, 130

[56] References Cited

U.S. PATENT DOCUMENTS

| | | | |
|---|---|---|---|
| 2,959,481 | 11/1960 | Kucera | 430/96 |
| 3,640,710 | 2/1972 | Mammino et al. | 430/96 |
| 4,258,089 | 3/1981 | Anderson et al. | 427/366 |
| 4,296,190 | 10/1981 | Hasegawa et al. | 430/96 |
| 4,599,288 | 7/1986 | Fuchizawa | 430/49 |

*Primary Examiner*—John L. Goodrow

*Attorney, Agent, or Firm*—Marmorek, Guttman & Rubenstein

[57] ABSTRACT

A photosensitive member for use in electrophotography in manufactured by preparing a coating material by mixing together a powder of photosensitive material, for example $\alpha$ or $\epsilon$ phthalocyanine, and a binder of a self-hardening type resin, for example a polyester resin, applying the coating material on the surface of a hollow metal cylinder to form a photosensitive layer, smoothing the surface of the photosensitive layer by applying a mechanical force, and hardening the photosensitive layer by heat or ultraviolet ray.

20 Claims, 1 Drawing Sheet

PHOTOSENSITIVE MEMBERS FOR USE IN ELECTROPHOTOGRAPHY

This is a continuation of application Ser. No. 081,999, filed Aug. 5, 1987, now abandoned.

BACKGROUND OF THE INVENTION

This invention relates to a photosensitive member or a photoconductor for use in electrophotography.

It is advantageous that the surface of a photoconductor utilized in electrophotography is smooth as far as possible. The flatness of the surface of the photoconductor is important for the reasons that when a powder image formed by applying a charged toner consisting of a fine powder onto a latent image is transfer printed onto a copying paper or the like, blur of the reproduced picture image could be prevented or decreased as the smoothness of the photoconductor is improved and that cleaning of the toner remaining on the photoconductor after transfer printing becomes easy and perfect as the flatness is improved. Since the photoconductor or photosensitive layer is subjected to friction caused by cleaning means and by the copying paper, the surface hardness of the photoconductor should be high, and the surface of the photoconductor should be wear resistant, these characteristics being important for elongating the life of the photoconductor. Recently, cleaning of the photoconductor is generally made with a cleaning blade so that the smoothness of the photoconductor governs the cleaning effect, whereas the hardness is an important factor that determines the life.

The prior art photoconductor is constituted by an electroconductive substrate, usually a metal cylinder, and a layer of a photosensitive fine powder coated on the surface of the substrate by using a binder made of a synthetic resin which hardens when a solvent evaporates off. The surface of the photosensitive layer has an irregularity of the order of several tens of micron, so that when the remaining toner is cleaned by a blade, a certain quantity of the toner particles will remain in the recesses on the surface of the photosensitive layer. Such remaining particles would be heated and solidified by the friction between the particles and the cleaning blade thus forming larger particles having a tendency of forming scratches on the surface of the photoconductor or damaging the edge of the cleaning blade. Moreover, as the surface hardness of the photosensitive layer is relatively low, that is about 2H in terms of the hardness of pencils, the photosenstive layer would be readily worn out by the frictions between the photosensitive layer and the blade and between the photosensitive layer and the copying paper thus decreasing the life of the photoconductor.

SUMMARY OF THE INVENTION

Accordingly, it is an object of this invention to provide an improved photosensitive member having improved smoothness and hardness thereby eliminating various defects described above.

According to one aspect of this invention, there is provided a photosensitive member for use in electrophotography comprising an electroconductive substrate, and a photosensitive layer coated on the substrate, the photosensitive layer being made of a mixture of a binder of a self-hardening type resin and a powder of a photosensitive material, the mixture being coated on the electroconductive substrate, and the photosensitive layer being smoothed mechanically and caused to self-harden.

According to another aspect of this invention, there is provided a method of manufacturing a photosensitive member for use in electrophotography comprising the steps of preparing a coating material by mixing together a powder of photosensitive material and a binder consisting of a self-hardening type resin, applying the coating material onto the surface of an electroconductive substrate to form a photosensitive layer, mechanically smoothing the surface of the photosensitive layer, and hardening the photosensitive layer, thereby completing the photosensitive member.

DESCRIPTION OF THE PREFERRED EMBODIMENT

Figure 1:
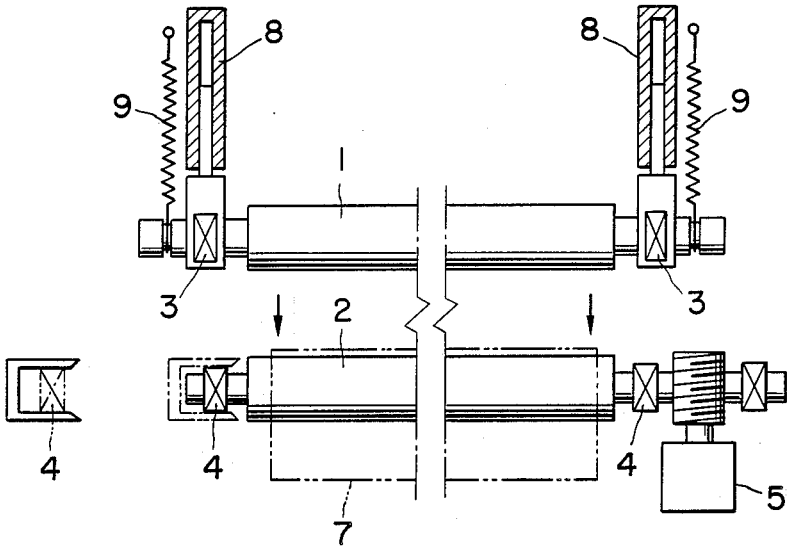
FIG. 1 is a plan view showing apparatus for manufacturing a photosensitive member embodying the invention.
Figure 2:
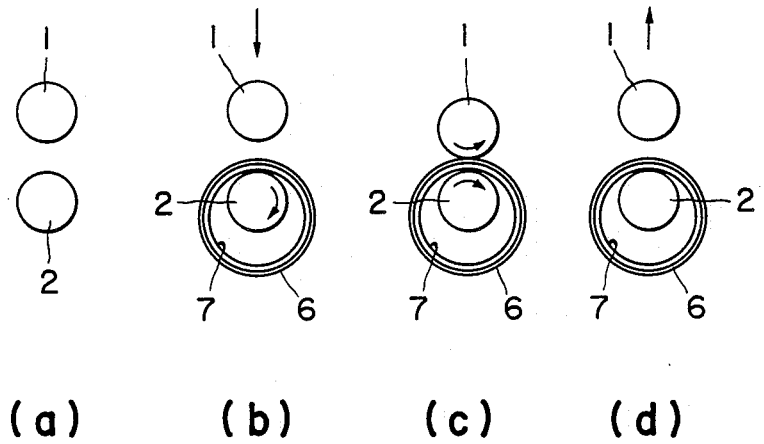
FIGS. 2*a* through 2*d* are plan views showing successive steps of manufacturing the photosensitive member shown in FIG. 1.

One example of apparatus for manufacturing a cylindrical photosensitive element will be described with reference to FIG. 1. The outer surface of an iron roller 1 having an outer diameter of 50 mm and a length of 300 mm is ground, electroplated with hard chromium and then mirror finished with a diamond tool to a surface smoothness or irregularity of less than 0.1 $\mu$. Further a rubber press roller 2 having a diameter of 50 mm and a length of 300 mm is prepared. As shown in FIG. 1, rollers 1 and 2 are supported by bearings 3 and 4 to rotate smoothly. The press roller 2 is driven by an electric motor 5 at any desired speed. When the lefthand bearing 4 is removed, the cylindrical photosensitive element coated with a photosensitive layer 6 (see FIG. 2) can be mounted and dismounted from the press roller 2 as shown by dot and dash lines shown in FIG. 1.

To each end of the mirror finished roller 1 are connected the piston rod of an air or oil pressure cylinder 8 and a returning spring 9 so that by controlling the pressure of air or oil it is possible to separate the roller 1 away from the press roller 2 or to urge the roller against the press roller at any desired pressure.

Successive steps of manufacturing the cylindrical photosensitive element are shown in FIGS. 2*a* through 2*d*.

More particularly, FIG. 2*a* shows the relation between the mirror finished roller 1 and the press roller 2 before applying a photosensitive layer 6.

FIG. 2*b* shows a state in which the metal cylinder 7 applied with the photosensitive layer 6 is mounted on the press roller 2. At this time, previously removed bearing 4 has been returned to the original position to support opposite ends of the press roller 2 and electric motor 5 is started to rotate the press roller 2. Then due to friction the photosensitive element (6,7) is also rotated.

At the next step shown in FIG. 2*c*, the mirror finished roller 1 is urged against the press roller 2 by air or oil pressure cylinders 8 for clamping the cylindrical photosensitive element between the rollers 1 and 2. Since the press roller 2 is made of soft rubber, the pressure applied between two rollers 1 and 2 is applied on the surface of the photosensitive element in the longitudinal direction thereof. This state is maintained for a suitable time to rotate the photosensitive element by a predetermined number of rotations.

FIG. 2*d* shows a state in which the mirror finished roller 1 has been moved away from the photosensitive layer 6 by gradually decreasing the pressure of air or oil in the cylinders 8. Thereafter motor 5 is stopped.

By the steps described above the surface of the photosensitive layer 6 is mechanically smoothed. Then the lefthand bearing 4 is removed to dismount the finished photosensitive element from the press roller 2.

Examples of the compositions of the photosensitive layer and methods of preparing the same are as follows.

Example 1

| Composition | |
|---|---|
| α phthalocyanine | 4 g |
| polyester resin (Almatex P645 - a trade name of Mitsui Toatsu Kagaku Co.) | 20 g |
| melamin resin (Uban 20HS - a trade name of Mitsui Toatsu Kagaku CO.) | 4 g |
| cyclohexane | 80.0 g |
| ethanol | 15.0 g |

The constituents were mixed together for 12 hours with a ball mill to form a liquid coating material. An aluminum cylinder finished to have an outer diameter of 80 mm, a wall thickness of 1 mm and a surface irregularity of 0.5 μ was coated with the coating liquid. Thickness of the coated liquid was controlled such that the thickness would be 12~13 μ after drying and hardening. Drying was made in air for about 2 hours at a room temperature of 25° C. The coating material was divided into two parts. One part was used to form the photosensitive layer 6. Its surface was smoothed and heated for one hour in an electric furnace maintained at a temperature of 150° C. Then the resulting photosensitive element was used to form a picture image. The other part was processed in the same manner as in the first mentioned part except that the air drying time was increased to 3 hours.

The smoothing treatment of the photosensitive layer was carried out in the following manner.

More particularly, the cylindrical photosensitive member whose photosensitive layer 6 has been air dried was mounted on the press roller 2 as shown by dot and dash lines in FIG. 1. The motor 5 was rotated at a speed of 5 r.p.m. and pressurized air was supplied to cylinders 8 to urge the mirror finished roller 1 against the photosensitive element for smoothing the photosensitive layer 6. Since the mirror finish roller 1 is normally pulled by the returning springs 9, the roller 1 can be urged at any desired pressure by adjusting the pressure of air or oil admitted into the cylinders 8. It is advantageous to adjust the pressure applied to the roller 1 such that a low pressure is applied when the roller 1 begins to contact the photosensitive layer 6, that the cylindrical photosensitive element is rotated more than one rotation after the contact pressure has been increased to a predetermined pressure, that the contact pressure is gradually decreased, and that the roller 1 is quickly separated.

In my experiment, compressed air of a pressure of 3 $kg/cm^2$ was used and the smoothing step was completed in about 5 minutes.

The composition of the coating liquid is characterized in that a mixture of a polyester resin and melamine resin is used as a binder. The molecules of these two resins are bridged together when heated so as to form a film having a large mechanical strength. Where air drying is used, a mechanical pressure is applied to make smooth the photosensitive layer.

The result of inspecting the surface smoothness or irregularly of the photosensitive layer 6 with a microscope shows that the surface of the photosensitive layer 6 not subjected to the smoothing step has an irregularity of larger than 1 μ on an average, whereas that of the surface subjected to the smoothing step is less than 0.1 μ.

The average particle diameter of phthalocyanine powder is less than 0.5 μ but the powder usually contains large particles of about 1 μ and as is well known in the art, since phthalocyanine does not satisfactorily disperse in a binder solution, it is impossible to perfectly disintegrate coagulated particles even when the particles are ground in a ball mill over a long time, so that by merely coating and drying the coating material it is difficult to obtain a surface like a mirror. The characteristics of a smoothed photosensitive layer are the same as those of not smoothed photosensitive layer at the initial state. But when the photosensitive layer is mounted on an electrophotographic copying machine utilizing so-called blade cleaning a remarkable difference appeared between smoothed and not smoothed photosensitive layers. With a not smoothed photosensitive layer, scratches are formed on the surface thereof only after 1000 copies are formed, this enhancing the attenuation of dark potential and decreasing the moisture proof property. In contrast, with a smoothed photosensitive layer, no scratch was noted after forming 2000 copies, meaning no change in the characteristics. Further even after forming 5000 copies, the photosensitive member operates quite satisfactory.

Although in the foregoing embodiment a mixture of two types of high molecular weight materials was used, it should be understood that the invention is not limited to such mixture. Generally stating, a binder that can be hardened or set with heat or ultraviolet ray can also be used. The binder and solvent used in the embodiment are mere examples. The percentage of phthalocyanine is also one example. My experiment shows that as the percentage of α phthalocyanine is increased the sensitivity of the photosensitive element increases. It is also possible to use a thermoplastic binder, in which case the mirror finished roller 1 is heated. The mirror finished roller can be coated with a Teflon coating or with a silicone mold release agent.

The α phthalocyanine powder was selected for the purpose of describing the advantageous effect of this invention. However, the other type photosensitive powder, for example ε phthalocyanine is also effective. Since ε phthalocyanine disperses well its effect is not remarkable. Moreover, since ε phthalocyanine has a low dark resistance it is advantageous to use a mixture of α and ε phthalocyanines at a suitable ratio. Then a photosensitive element can be obtained having a high sensitivity of ε phthalocyanine and a high dark resistance ofα phthalocyanine, and having perfectly smooth surface and a high mechanical strength.

Although in the foregoing description a P type photoconductor has been described, this invention is equally applicable to a N type photoconductor.

For example, a successful N type photoconductor can be obtained by using particles of CdS having a mean particle diameter of 3 μ and an epoxy resin as a binder. In the same manner, a powder of ZnO can also be used.

In summary, the photosensitive material that can be used in this invention includes phthalocyanine, CdS, CdSe, ZnO, ZnS, PbO and other well known substances, and as the binder, polyester, epoxy, melamine, acryl resins or the like can be used.

Example 2

The binder (polyester resin and melamine resin) utilized in Example 1 was substituted by a polyurethane resin. The coating material was prepared in the same manner as in Example 1. After forming the photosensitive layer using the coating material, the photosensitive element was dried in air and then the surface of the photosensitive layer was smoothed in the same manner as in Example 1. Then the photosensitive layer was maintained at a room temperature for 36 hours. Then by the function of oxygen in air, a bridging phenomenon is enhanced so as to obtain an excellent photosensitive element having smooth and hard surface as well as a high image forming performance.

As above described, according to this invention a mixture of a self-hardening type resin acting as a binder and a powder of a photosensitive material is coated on a hollow metal cylinder as a thin film so that the surface of the coated film is smoothed by mechanical means, and the resin is caused to self-harden. Accordingly, it is possible to produce a novel photosensitive layer having excellent smoothness and hardness. More particularly, the surface irregularity of the photosensitive layer of this invention is less than 0.1 μ. With such photosensitive layer, a toner image can be accurately and clearly transferred without any blur. Furthermore the surface of the photosensitive layer can be readily cleaned with a conventional blade and since the photosensitive layer has a hardness of 6H of a pencil it would not be broken or worn out by the friction between the layer and the cleaning blade or copying paper, thus elongating the operating life of the photosensitive element.

What is claimed is:

1. A photosensitive member for use in electrophotography comprising:
   - an electroconductive substrate;
   - a photosensitive layer comprising a photoconductive material on said substrate;
   - said photosensitive layer comprising a mixture of a binder of a self-hardening type resin and a finely divided powder of a photoconductive material;
   - said photosensitive layer having a mirror finish with a surface irregularity of less than 0.1 μ.

2. The photosensitive member according to claim 1 wherein said electroconductive substrate takes the form of a metal cylinder.

3. The photosensitive member according to claim 1 wherein said photosensitive material is selected from the group consisting of α phthalocyanine, ε phthalocyanine, a mixture thereof, CdS, CdSe, ZnO, ZnS and PbO.

4. The photosensitive member according to claim 1 wherein said self-hardening type resin is selected from the group consisting of polyester, epoxy, melamine and acryl resins, and mixtures thereof.

5. The photosensitive member according to claim 4 wherein said self-hardening type resin hardens when heated, irradiated with ultraviolet ray or dried in air.

6. The photosensitive member according to claim 1 wherein said substrate is cylindrical in shape 7. The photosensitive member according to claim 1 wherein said photoconductive material is a phthalocyanine.

8. The photosensitive member according to claim 1 wherein said photosensitive layer has a surface hardness of at least about 6H in terms of pencil hardness.

9. The photosensitive member according to claim 1 wherein said photoconductive material comprises a pulverized powder.

10. A method of manufacturing a photosensitive member for use in electrophotography, comprising the steps of:
   - preparing a coating material by mixing together a powder of photoconductive material and a binder of a self-hardening type resin;
   - applying said coating material onto a surface of an electroconductive substrate to form a photosensitive layer;
   - hardening said photosensitive layer; and
   - thereafter mechanically smoothing said photosensitive layer to a mirror finish having a surface irregularity of less than 0.1 μ.

11. The method according to claim 10 wherein said photoconductive material is a phthalocyanine.

12. The method according to claim 10 wherein said mechanical smoothing step is performed at room temperature.

13. The method according to claim 10 wherein said mechanical smoothing step comprises pulverizing said powder of photoconductive material in said photosensitive layer.

14. The method according to claim 10 wherein said substrate is cylindrical in shape and wherein said mechanical smoothing step comprises applying mechanical pressure to said photosensitive layer while rotating said cylindrical substrate.

15. The method according to claim 10 wherein said photosensitive layer has a surface hardness of at least about 6H in terms of pencil hardness.

16. The method according to claim 10 wherein said substrate is a hollow metal cylinder and said hollow metal cylinder formed with said photosensitive layer is interposed between a pair of rollers which are pressed together.

17. The method according to claim 16 wherein one of said rollers is urged against the other roller by a fluid pressure piston-cylinder assembly and moved away from said other roller by returning spring means.

18. The method according to claim 19 wherein said photosensitive material is selected from the group consisting of α phthalocyanine, ε phthalocyanine, a mixture thereof, CdS, CdSe, ZnO, ZnS and PbO.

19. The method according to claim 10 wherein said self-hardening type resin is selected from the group consisting of polyester, epoxy, melamine and acryl resins and mixtures thereof.

20. The method according to claim 10 wherein said self-hardening type resin hardens when heated or irradiated with ultraviolet ray or dried in air.

* * * * *